United States Patent [19]

Harley

[11] 4,046,441

[45] Sept. 6, 1977

[54] ASSEMBLIES INCLUDING ELECTRICAL INTERCONNECTIONS

[75] Inventor: David Murray Harley, Edinburgh, Scotland

[73] Assignee: Ferranti Limited, Hollinwood, England

[21] Appl. No.: 744,348

[22] Filed: Nov. 23, 1976

[30] Foreign Application Priority Data

Nov. 26, 1975 United Kingdom ..... 48699/75

[51] Int. Cl.[2] ..... H01R 39/00

[52] U.S. Cl. ..... 339/8 R; 339/103 M

[58] Field of Search ..... 339/8 R, 6 R, 103 M

[56] References Cited

U.S. PATENT DOCUMENTS

| | | | |
|---|---|---|---|
| 2,433,938 | 1/1948 | Varner | 339/8 R |
| 2,766,625 | 10/1956 | Swanson | 339/8 R X |

*Primary Examiner*—Roy Lake
*Assistant Examiner*—DeWalden W. Jones
*Attorney, Agent, or Firm*—Cameron, Kerkam, Sutton, Stowell & Stowell

[57] ABSTRACT

An assembly includes two members, such as gyroscope gimbals, capable of limited relative rotation, and a flat, flexible conductor strip secured to the members, the axis of the strip extending between its securing positions wholly extending towards the common axis of rotation of the members the strip axis lying in a plane with the members at their mean relative orientation, and twisting as the members rotate therefrom.

15 Claims, 3 Drawing Figures

ASSEMBLIES INCLUDING ELECTRICAL INTERCONNECTIONS

Figure 1:
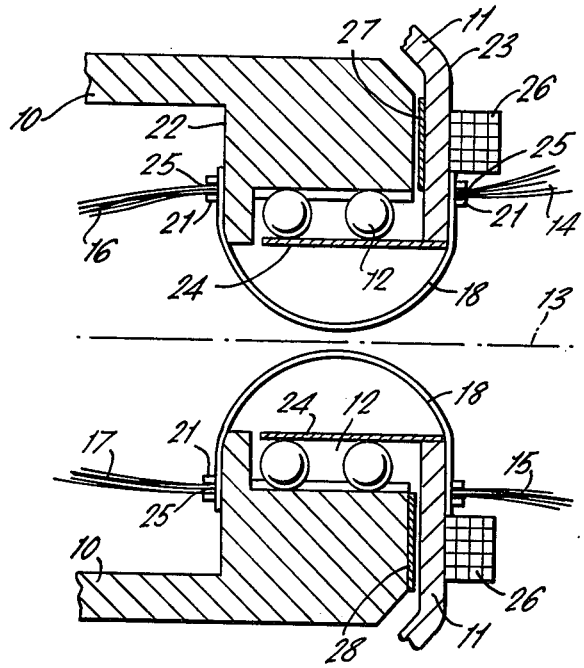

This invention relates to assemblies including electrical interconnections, and in particular to such assemblies each including two members capable of limited relative rotation about a common axis, and an electrical interconnection secured to two positions, one on each of the two members.

Limited relative rotation about the common axis is where relative rotation between the two members is permitted over a range less than 360°. The mean relative orientation of the two members is where, assuming one member to be fixed, the other member is capable of the same permitted range of rotation, less than 180°, in each of two possible directions of rotation. At the limits of relative rotation of the two members, and again assuming one member to be fixed, the other member is capable of rotation only in one direction.

In known forms of such assemblies it is usual for the permitted range of relative rotation of the two members to be considerably less than 360°.

Further, the use of electrical interconnections each including a flexible conductor strip having a mean width greater than its thickness, in relation to the axis of the strip extending between the securing positions on the two members, usually makes the provision of the electrical interconnections more difficult than if a substantially circular-section electrical interconnection is employed, because of the difficulty of accommodating such a strip satisfactorily within the assembly. Hence, usually, the use of such strips in assemblies of the kind referred to above is avoided. Usually under normally encountered operating conditions the strip is inextensible. Such a strip may have a single conductor or a plurality of conductors. A strip of the form referred to above is advantageous when the electrical interconnection is required to have a plurality of conductors, because its shape facilitates the connection of terminals or other conductors to the electrical interconnection. Such a strip may be in the form of a flexible printed circuit having an insulating covering for the conductors. In any event, each conductor of the electrical interconnection is covered with insulating material, but is is desirable that the arrangement of the assembly is so that the electrical interconnection does not inadvertently touch any other part of the assembly.

It is an object of the present invention to provide a novel, and simple, form of an assembly of the kind referred to above, and having an electrical interconnection including a flexible conductor strip with a mean width greater than its thickness in relation to the axis of the strip extending between the securing positions on the two members.

According to the present invention an assembly includes two members capable of limited relative rotation about a common axis and an electrical interconnection at least including a flexible conductor strip, secured to two positions, one on each of the two members, and spaced from the common rotational axis, in relation to the axis of the strip extending between said securing positions on the two members, the strip having a mean width greater than its thickness, and with the members at one particular orientation in relation to each other, intermediate between their limits of relative rotation, the axis of the strip lying in a plane and wholly extending towards the common rotational axis of the members.

The electrical interconnection may be secured to the two members in any convenient way, for example, being clamped to the members.

Relative rotation of the two members from said one particular relative orientation causes the axis of the strip extending between said securing positions on the two members to twist. The strip is bent, and extends slackly, with the two members in said one particular relative orientation.

The limits of relative rotation of the two members may be defined by comprising the relative orientations of the two members in which the edges of the strip become linear due to rotation of the two members. However, usually the limits of relative rotation are defined by at least one stop part on one of the two members, the stop part either engaging the other member or engaging an anchorage, before the edges of the strip become linear due to relative rotation of the two members. By avoiding the edges of the strip becoming linear substantially resilient, or permanent, deformation of the strip, which may otherwise occur, is avoided.

Further, in order to avoid substantially resilient, or permanent, deformation of the strip, whilst the permitted range of relative rotation of the two members easily may be greater than 180°, the permitted range should not approach 360°.

Conveniently, the two members may be annular, and one of the two members may have a part within the central bore of the other member, a common central bore being defined by the members, the strip extending through at least part of the common central bore, if said part of said one member does not extend completely through the other member. The central bore of either annular member may have any convenient shape in section. The axis of the flexible conductor strip may enter the common central bore at points spaced from the walls defining the bore, because of the finite width of the strip. Two such annular members may be included within a bearing. Further, one of the two members carry the coil of an electrical motor connected to the electrical interconnection. Thus, the two members may be gimbals, with a torque motor to control a gyroscope gimbal. Usually gyroscopes, in operation, are to be subjected to high accelerational forces, and in an assembly according to the present invention, having a flexible conductor strip with a mean width greater than its thickness, is advantageous because the strip easily can be accommodated, but the bent strip has inherent rigidity. Further, it is desirable that the torque motor is not required to provide greater torque than is possible in order to cause relative rotation of the members, and hence resilient deformation of the flexible strip should be as low as possible.

It is self-apparent that the flexible strip should not be permanently deformed.

Resilient deformation of the strip by relative rotation of the two members may be less than otherwise would be the case by having an arrangement in which the axis of the strip extends between said securing positions on the two members substantially wholly, and at least within the common central bore of annular members, when provided, in a smooth curve, when the axis lies in said plane. In addition, or alternatively, the resilient deformation of the strip is less than otherwise would be the case when the axis of the strip extends to a point at least adjacent to the common rotational axis of the two members. In the latter arrangement, because the axis of the strip extends to substantially the same point for any permitted relative orientation of the members; and in either arrangement, at least over small permitted ranges of relative rotation of the members; the axis twists with the minimum deformation of the strip. Conveniently, said securing positions on the two members are substantially uniformly spaced from the common rotational axis of the members, and the strip extends furthest from said securing positions in a plane substantially equidistant from said securing positions.

Usually the flexible conductor strip has a substantially uniform thickness, and may have a negligible thickness. Whilst it may have any convenient shape in plan, it may be ribbon-shaped, having a substantially uniform width, and having a length greater than its width, the longitudinal symmetrical axis of the strip comprising the axis extending between said securing positions on the two members. If the strip has a plurality of conductors, the conductors extend substantially parallel to each other having along the length of the strip.

In general, the part of the strip furthest from said securing positions on the members rotates; and deforms by curving about the axis of the strip extending between said securing positions; by relative rotation of the two members. However, at either of the limits of relative rotation of the two members this part of the strip desirably should not be significantly more curved transverse to the longitudinal axis of the strip than with the two members at their said one particular relative orientation. This deformation should be at a minimum, especially when the flexible conductor strip is ribbon-shaped, because it may be the only deformation of the strip over a substantial range of relative rotation of the two members. It may be possible to arrange that the section of the part of the strip furthest from said securing positions extends linearly transverse to the axis of the strip with the two members midway between their mean relative orientation and either limit of relative rotation, the section being curved in opposite directions with the two members at their mean relative orientation and when at their limits of relative rotation.

A plurality of flexible conductor strips, and especially ribbon-shaped strips, may be provided substantially uniformly distributed about the common rotational axis of the two members. It is essential that the constituent strips do not touch each other with the members at their said one particular relative orientation. Because of the rotation of the part of each strip furthest from said securing positions during relative rotation of the members the plurality of strips do not tend to touch each other because of relative rotation of the members. Whether the strips are ribbon-shaped or not, a convenient arrangement is one in which two strips are provided, diametrically opposite to each other in relation to the common rotational axis of the members. Usually the plurality of conductor strips are substantially identical.

Figure 2:
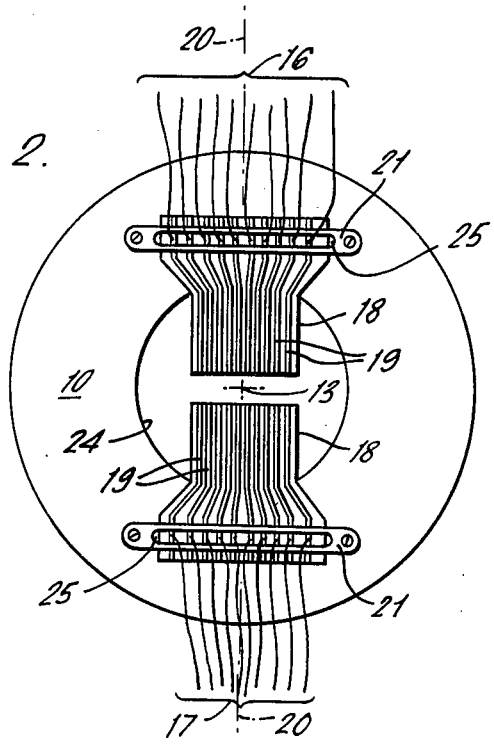
Figure 3:
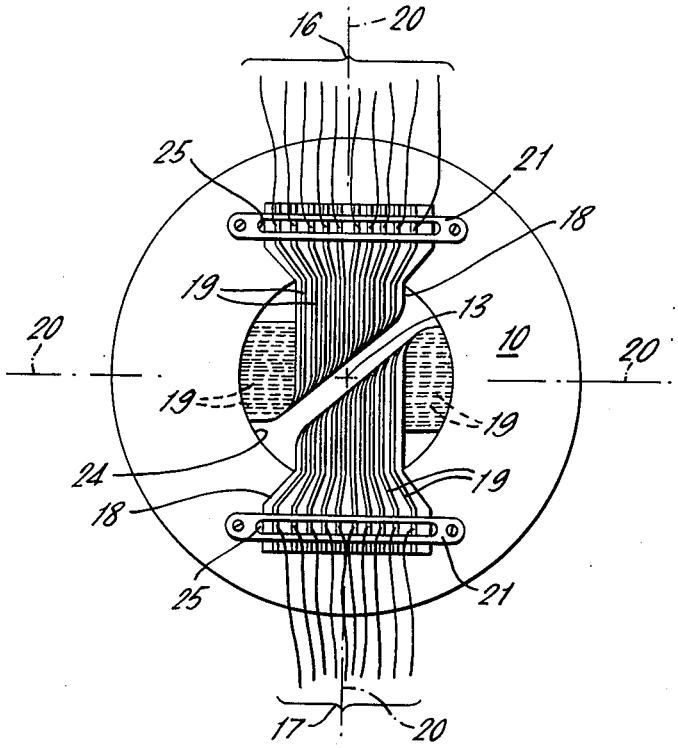

One specfic embodiment according to the present invention will now be described, by way of example, with reference to the accompanying drawings, in which FIG. 1 shows a sectional side view of an assembly having an electrical interconnection secured to two relatively rotatable members, comprising parts of gyroscope gimbals, FIG. 2 shows an end view of the gimbals of FIG. 1, the members being in their mean relative orientation intermediate between the limits of their relative rotation, and FIG. 3 is as FIG. 2, but with the members rotated to one of their limits of relative rotation.

As illustrated, annular members 10 and 11 are respectively outer and inner gimbal frames of a gyroscope, not otherwise shown. The members 10 and 11 are relatively rotatable by means of a ball bearing 12 about a common rotational axis 13. The groups of leads 14 and 15 are connected to corresponding groups of leads 16 and 17 by way of an electrical interconnection secured to the two members 10 and 11, and comprising two identical flexible conductor strips 19 arranged diametrically opposite to each other in relation to the axis 13. The strips 18 are ribbon shaped each having a width greater than its thickness. Each strip 18 has a uniform, but negligible, thickness, and a substantially uniform width, the length of the strip being greater than its width. The strips 18 comprise flexible printed circuits having a plurality of substantially parallel conductors 19 (FIGS. 2 and 3) enclosed within insulating material. In each strip 18 the conductors 19 extends substantially parallel to the longitudinal axis 20 of the strip.

Clamps 21 hold the ends of the flexible strips against the outer face 22 of the outer member 10, and against the outer face 23 of the inner member 11. The longitudinal axis 20 of each strip can be considered as extending from the clamps 21, the clamps 21 being considered to be at the securing positions for the strips on the members 10 and 11.

The members 10 and 11 have a common central bore 24 and the strips extend between the clamps 21 through the bore 24. Each strip wholly extends towards the common rotational axis 13 of the members, the strip being bent. Thus, the strip can be considered as extending slackly between the clamps.

The groups of leads 14, 15, 16 and 17 are soldered to the conductors 19 of the strips, the soldered joints being within a slot 25 in each clamp. Thus, the flexible strip is supported on each side of the soldered joints.

A coil 26 of a torque motor is carried on the inner member 11, and is connected to two of the conductors 19.

Limited relative rotation about the common axis 13 is permitted between the members 10 and 11 over a range less than 360°, and in the illustrated embodiment this range is substantially 180°. The mean relative orientation of the members 10 and 11 is where, assuming one member to be fixed, the other member is capable of the same permitted range of rotation, substantially 90°, in each of two possible directions of rotation.

At the limits of relative rotation of the members 10 and 11, and against assuming one member to be fixed, the other member is capable of rotation only in one direction. The limits of relative rotation are defined by a stop part 27 on the outer member 10 abutting against a co-operating, semicircular part 28 on the inner member 11.

In one particular relative orientation of the members 10 and 11, as shown in FIGS. 1 and 2, and which in the illustrated embodiment is their mean relative orientation, the longitudinal axis 20 of each strip 18 lies in a plane. Relative rotation of the two members from their mean relative orientation causes the longitudinal axis 20 of each strip to twist.

As shown in FIG. 3, the two members are at one of the limits of relative rotation. It will be seen that the edges of the strips are not linear at the limits of relative rotation.

Whilst it is essential that the strips do not touch each other with the members 10 and 11 at their mean relative orientation, implying that the strips cannot extend to the common rotational axis 13 of the members, they may conveniently extend to adjacent to the axis 13. Relative rotation of the two members causes the part of each strip furthest from the clamps 21, and transverse to the longitudinal axis of the strip, to rotate about the longitudinal axis, ensuring that the strips do not touch because of relative rotation of the members.

The limits of relative rotation of the two members may be defined in various ways, for example, there being many possible arrangements including stop parts mounted on the members. If stop parts are not provided, the limits of relative rotation are defined by when the edges of the strips become linear. However, substantial resilient, or permanent, deformation of the strips may occur when their edges become linear.

Further, in order to avoid substantial resilient, or permanent, deformation of each strip it is desirable that the permitted range of relative rotation of the members should not approach 360°, although it is possible easily to avoid deformation and have a permitted range of relative rotation of the members greater than 180°.

Conveniently, as shown, the clamps 21 are substantially uniformly spaced from the common rotational axis 13 of the members, and each strip extends furthest from the clamps in a plane substantially equidistant from the clamps.

Whilst permanent deformation of each strip should be avoided, it is also desirable to avoid resilient deformation of the strip in order that the torque required to cause the relative rotation of the members is as small as possible. This is particularly so when the assembly of the members 10 and 11 and the electrical interconnection secured to the members is part of a gyroscope gimbal arrangement. Thus, a torque motor is required to provide as small a torque as possible in order to cause relative rotation of the members.

Deformation of each strip may be less than otherwise would be the case by the longitudinal axis of the strip extending substantially wholly in a smooth curve, as shown in FIG. 1, and at least when within the common central bore 24 of the members facilitating the twisting of the longitudinal axis of the strip.

Deformation of each strip may be less than otherwise would be the case by the longitudinal axis strip extending to a point adjacent to the common rotational axis 13 of the members, as illustrated. Hence, the axis 20 extends to substantially the same point for any permitted relative orientation of the members 10 and 11.

In general, relative rotation of the two members causes the part of each strip furthest from the clamps to deform by curving about the longitudinal axis of the strip. However, at either of the limits of relative rotation of the two members this part of the strip desirably should not be significantly more curved transverse to the longitudinal axis of the strip than with the two members at their mean relative orientation. In the FIGURES no such deformation is shown.

The gyroscope may have any convenient construction, for example, as described in Inertial Guidance Engineering by M. Fernandez and G. R. Macomber, Prentice-Hall Inc. 1962.

Usually gyroscopes, in operation, are to be subjected to high accelerational forces, but the bent strips, comprising an electrical interconnection according to the present invention, have inherent rigidity.

It will be appreciated that the electrical interconnection described above can be modified in various ways. For example each flexible strip used could be a single flat conductor, or a plurality of insulated conductors arranged to be a coplanar i.e. a flat cable.

The number of conductors per flexible strip could be increased by providing conductors on the outside of the insulation, suitable insulating means being provided to isolate the conductors from the surface to which the ends of the strip are clamped.

It may be possible to arrange that the section of the strip furthest from the clamps extends linearly transverse to the axis of the strip with the two members midway between their mean relative orientation and either limit of relative rotation, the section being curved in opposite directions with the two members at their mean relation orientation and when at their limits of relative rotation.

The electrical interconnection may comprise any convenient plurality of strips substantially uniformly distributed about the common rotational axis of the members 10 and 11. It is essential that the constituent strips are not capable of touching each other with the members at their mean relative orientation.

Alternatively, only one strip may be provided, and this strip may extend beyond the common rotational axis 13 of the members 10 and 11, although advantageously it extends only to the axis 13.

Especially if one strip, or two diametrically opposite strips, are provided the strips may have any convenient shape in plan. However, it is required that the mean width of each strip is greater than the thickness. The thickness need not be uniform, and may not be negligible. Each strip could be circular in plan.

Usually under normally-encountered conditions each strip is inextensible.

A further modification facilitating assembly, and improving reliability, comprises continuing the flexible strip beyond the clamps in place of the soldered leads.

The strips may be secured to the members in any convenient way, for example, a pin and socket connector might be provided at the point at which each flexible strip is secured so removing the need for soldered joints and clamps.

The assembly according to the present invention may not be part of a gyroscope.

The relatively rotatable members may have any convenient shape, and may not include a bearing, or indeed have a common central bore. If one member does not have a part extending completely through the other member, each strip may not extend completely through the common central bore. The central bore of either annular member may have any convenient shape in section. The axis of the flexible conductor strip may enter the common central bore at points spaced from the walls defining the bore, because of the finite width of the strip.

The members may not be annular, but are spaced apart with the electrical interconnection extending therebetween.

What I claim is:

1. An assembly including two members capable of limited relative rotation about a common axis and an electrical interconnection at least including a flexible conductor strip secured to two positions, one on each of the two members, and spaced from the common rotational axis, in relation to the axis of the strip extending between said securing positions on the two members, the strip having a mean width greater than its thickness, and with the members at one particular orientation in relation to each other, intermediate between their limits of relative rotation, the axis of the strip lying in a plane and wholly extending towards the common rotational axis of the members.

2. An assembly as claimed in claim 1 in which said one particular relative orientation of the two members is the mean relative orientation of the two members.

3. An assembly as claimed in claim 1 in which the limits of relative rotation of the two members are defined by at least one stop part on one of the two members.

4. An assembly as claimed in claim 1 in which the two members are annular, and one member has a part within the central bore of the other member, a common central bore being defined by the members, the strip extending through at least part of the common central bore.

5. An assembly as claimed in claim 4 in which the two annular members are included within a bearing.

6. An assembly as claimed in claim 4 in which one of the two members carries the coil of an electrical motor connected to the electrical interconnection.

7. An assembly as claimed in claim 6 in which the two members are gyroscope gimbals, with a torque motor to control a gyroscope gimbal.

8. An assembly as claimed in claim 1 in which the axis of the strip substantially wholly extends between said securing positions on the two members in a smooth curve, when the axis lies in said plane.

9. An assembly as claimed in claim 1 in which the axis of the strip extends to a point at least adjacent to the common rotational axis of the two members.

10. An assembly as claimed in claim 1 in which said securing positions on the two members are substantially uniformly spaced from the common rotational axis of the members, and the strip extends furthest from said securing positions in a plane substantially equidistant from said securing positions.

11. An assembly as claimed in claim 1 in which the flexible conductor strip is ribbon-shaped, having a length greater than its width, the longitudinal symmetrical axis of the strip comprising the axis extending between said securing positions on the two members.

12. An assembly as claimed in claim 11 in which at either of the limits of relative rotation of the two members the part of the strip furthest from said securing positions on the members is not significantly more curved transverse to the longitudinal axis of the strip than with the two members at their said one particular relative orientation.

13. An assembly as claimed in claim 11 in which a plurality of flexible, ribbon-shaped conductor strips are provided, substantially uniformly distributed about the common rotational axis of the two members, no constituent strip being capable of extending to the common rotational, axis of the members, and the strips do not touch each other with the members at their said one particular relative orientation.

14. An assembly as claimed in claim 1 in which two flexible conductor strips are provided, the strips being arranged diametrically opposite to each other in relation to the common rotational axis of the members, and with neither member being capable of extending to the common rotational axis of the members, and the strips do not touch each other with the members at their said one particular relative orientation.

15. An assembly as claimed in claim 14 in which the plurality of conductor strips are substantially identical.

* * * * *